US008534798B2

(12) United States Patent
Miyazaki et al.

(10) Patent No.: US 8,534,798 B2
(45) Date of Patent: Sep. 17, 2013

(54) INK JET RECORDING HEAD

(75) Inventors: Kyota Miyazaki, Tama (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 12/793,625

(22) Filed: Jun. 3, 2010

(65) Prior Publication Data

US 2010/0309258 A1 Dec. 9, 2010

(30) Foreign Application Priority Data

Jun. 9, 2009 (JP) ..... 2009-138184

(51) Int. Cl.
*B41J 2/14* (2006.01)
*B41J 2/16* (2006.01)

(52) U.S. Cl.
USPC ..... 347/50

(58) Field of Classification Search
USPC ..... 347/50, 40
See application file for complete search history.

(56) References Cited

U.S. PATENT DOCUMENTS

| | | | | |
|---|---|---|---|---|
| 5,734,394 | A * | 3/1998 | Hackleman | 347/42 |
| 7,533,960 | B2 * | 5/2009 | Yasuda et al. | 347/40 |
| 2010/0156994 | A1 * | 6/2010 | Shimomura et al. | 347/50 |

FOREIGN PATENT DOCUMENTS

| | | | |
|---|---|---|---|
| JP | 2007-294847 | A | 11/2007 |
| JP | 2007-296638 | | 11/2007 |
| JP | 2008-288536 | A | 11/2008 |
| JP | 2009-006560 | A | 1/2009 |
| KR | 10-0872212 | B1 | 12/2008 |

* cited by examiner

*Primary Examiner* — Matthew Luu
*Assistant Examiner* — Renee I Wilson
(74) *Attorney, Agent, or Firm* — Canon USA Inc IP Division

(57) ABSTRACT

An ink jet recording head includes a supporting member, a plurality of recording element substrates secured to the supporting member while being arranged along a lengthwise direction of the supporting member and including a discharge port configured to discharge a droplet and an electrode formed at an end in the lengthwise direction and receives an electric signal that controls the discharge of the droplet from the discharge port, an electric wiring member secured to the supporting member and including a plurality of device holes configured to individually expose the plurality of recording element substrates and an electrode terminal formed in the periphery of the plurality of device holes in the lengthwise direction to transmit the electric signal to the electrode, and a wire configured to connect the electrode and the electrode terminal, and the electric wiring member is at least discontinued between the adjacent device holes in the lengthwise direction.

11 Claims, 20 Drawing Sheets

INK JET RECORDING HEAD

BACKGROUND OF THE INVENTION

1. Field of the Invention

The present invention relates to an ink jet recording head mounted on an ink jet recording apparatus that performs recording operation by discharging ink.

2. Description of the Related Art

Generally, an ink jet recording head mounted on an ink jet recording apparatus, which performs recording operation by discharging ink, includes a recording element substrate having a discharge port array of a plurality of discharge ports. The recording can be performed at higher speed when the length of the discharge port array is longer.

In such circumstances, in recent years, there has been a growing demand for ink jet recording heads, for example, with a recording width of 4 to 12 inches, which meet the demand for high-speed printing of fine images. However, if a recording element substrate with a long discharge port array is used, the possibility of the problems described below is increased.

Generally, in addition to the discharge port array, a recording element substrate includes recording elements (e.g., electrothermal conversion elements) of a great number that corresponds to the number of the discharge ports. Thus, when the recording elements are arranged on a single recording element substrate, the recording element substrate will be very long. As a result, the possibility of a crack or warpage of the recording element substrate is increased.

Japanese Patent Application Laid-Open No. 2007-296638 discusses an inkjet recording head that can solve such a problem. The inkjet recording head includes a plurality of recording element substrates arranged in an array. According to this configuration, an ink jet recording head of a long recording width is realized without using a single long recording element substrate.

FIG. 18 is a front view of an ink jet recording head with a plurality of recording element substrates according to an exemplary embodiment of the present invention. An ink jet recording head H2000 illustrated in FIG. 18 includes a plurality of recording element substrates H2010, an electric wiring member H2020, and a supporting member H2030.

The recording element substrate H2010 and the electric wiring member H2020 of the ink jet recording head H2000 are secured to the supporting member H2030. Further, as illustrated in FIG. 19, the recording element substrate H2010 is connected to the electric wiring member H2020 by a gold or aluminum wire H1303. FIG. 19 is an enlarged cross-sectional view of an electrical connection portion of the recording element substrate H2010 and the electric wiring member H2020.

The material of the recording element substrate H2010 is silicon, and its coefficient of linear expansion is approximately 3 ppm. The material of the electric wiring member H2020 is resin, and its coefficient of linear expansion is approximately 10 to 30 ppm. The material of the supporting member H2030 is alumina, and its coefficient of linear expansion is approximately 7 ppm.

When a change in temperature occurs due to a recording operation or change in environment, the recording element substrate H2010, the electric wiring member H2020, and the supporting member H2030 of the ink jet recording head H2000 expand/contract in the lengthwise direction of the supporting member H2030 (direction of the arrow A100 in FIG. 20).

At this time, since the coefficient of linear expansion of the electric wiring member H2020 is greater than the coefficient of linear expansion of the recording element substrate H2010, a difference in the amount of expansion/contraction of the components is generated. As a result, the wire H1303 is pulled and the possibility of a breakage of the wire H1303 is increased. If the wire H1303 is broken, the recording element substrate H2010 will not be able to receive electric signals and power and, consequently, ink is not properly discharged. Thus, the breaking of the wire H1303 results in poor image quality.

SUMMARY OF THE INVENTION

The present invention is directed to a method useful for improving reliability of an electric connection of an ink jet recording head having a plurality of recording element substrates arranged in an array.

According to an aspect of the present invention, an ink jet recording head includes a supporting member, a plurality of recording element substrates secured to the supporting member while being arranged along a lengthwise direction of the supporting member and including a discharge port configured to discharge a droplet and an electrode formed at an end in the lengthwise direction and receives an electric signal that controls the discharge of the droplet from the discharge port, an electric wiring member secured to the supporting member and including a plurality of device holes configured to individually expose the plurality of recording element substrates and an electrode terminal formed in the periphery of the plurality of device holes in the lengthwise direction to transmit the electric signal to the electrode, and a wire configured to connect the electrode and the electrode terminal. The electric wiring member is at least discontinued between the device holes adjacent to each other in the lengthwise direction.

According to the present invention, when a temperature change occurs, since the electric wiring member is discontinued between the device holes adjacent in the lengthwise direction of the supporting member, the amount of expansion/contraction of the electric wiring member between the device holes can be reduced compared to when a conventional electric wiring member is used. Thus, the difference between the amount of expansion/contraction of the electric wiring member and the amount of expansion/contraction of the recording element substrate between the device holes is reduced. Further, since the wire that connects the electrode of the recording element substrate and the electrode terminal of the electric wiring substrate is less prone to breaking, reliability of the electrical connection between the recording element substrate and the electric wiring substrate is increased.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In this specification, "recording" is to form an image, a design, a pattern, or the like, in addition to a character or a figure, on a recording medium or to process a medium regardless of whether the formed image, the design, the pattern, or the like is visualized so as to allow a user to visually perceive it.

Further, in this specification, various types of "recording media" can be used for recording so long as they can be printed with ink. The recording media include, for example, a cloth, a plastic film, a metal sheet, glass, ceramics, wood, and leather.

The terms "ink" or "liquid" should be widely construed as is with the "recording" described above, and includes all types of liquid used for recording. The "ink" is a liquid that is applied to a printing medium to form an image, a design, a pattern, or the like, or to process the printing medium. Further, the "ink" is a liquid used for ink processing (e.g., solidification or insolubilization of a color material in ink applied to the recording medium).

Figure 1:
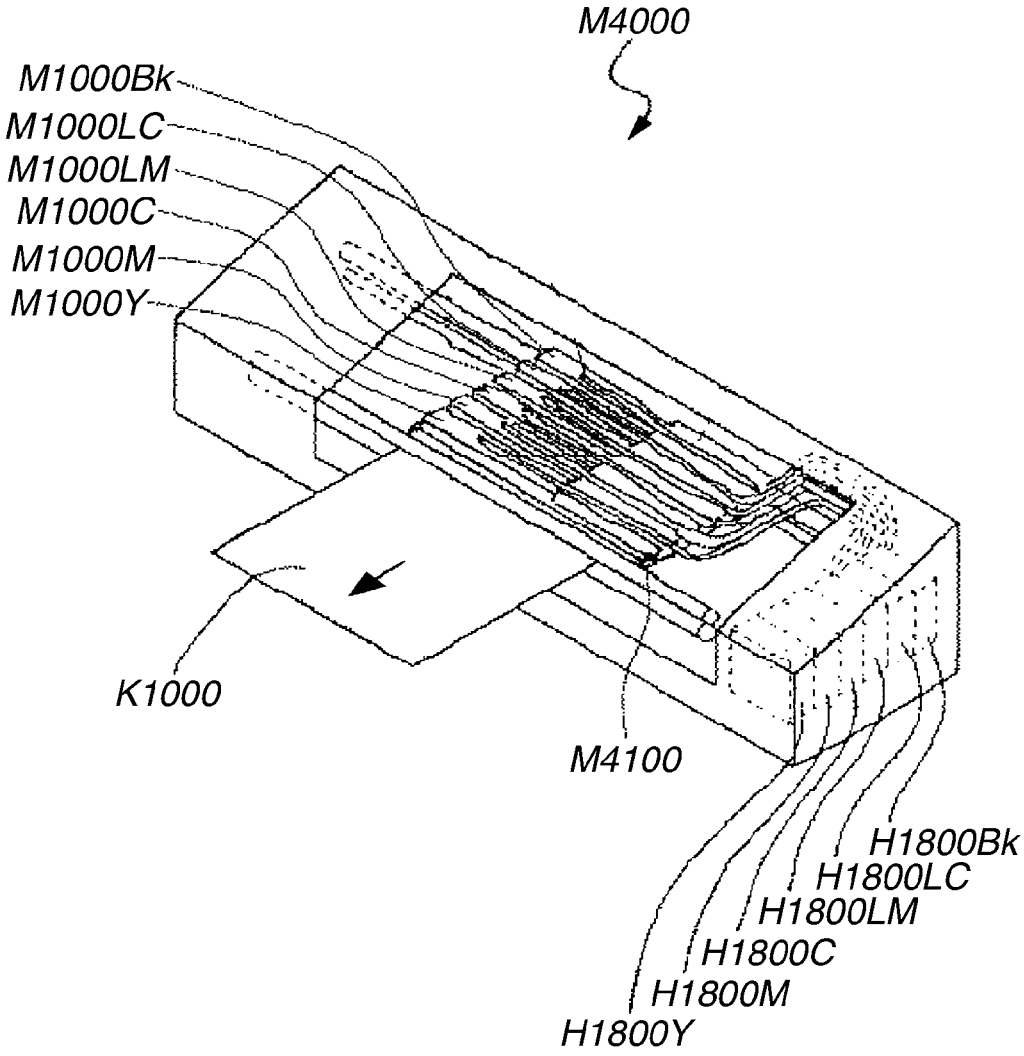
FIG. 1 is a perspective view of an ink jet recording apparatus mounting an ink jet recording head according to an exemplary embodiment of the present invention.

FIG. 1 is a perspective view of an ink jet recording apparatus mounting an ink jet recording head according to an exemplary embodiment of the present invention. The ink jet recording head according to the present invention is mountable, in addition to a common ink jet recording apparatus, on a recording apparatus such as a copying machine, a fax machine including a communication system, or a word processor including a print unit. Further, the ink jet recording head according to the present invention can be used in an industrial recording apparatus combined with various processing apparatuses.

An ink jet recording apparatus M4000 illustrated in FIG. 1 includes ink jet recording heads for six colors.

An ink jet recording head H1000Bk discharges black ink contained in an ink tank H1800Bk. An ink jet recording head H1000C discharges cyan ink contained in an ink tank H1800C. An ink jet recording head H1000M discharges magenta ink contained in an ink tank H1800M. An ink jet recording head H1000Y discharges yellow ink contained in an ink tank H1800Y. An ink jet recording head H1000LC discharges light cyan ink contained in an ink tank 1800LC. An ink jet recording head H1000LM discharges light magenta ink contained in an ink tank H1800LM. The ink jet recording heads H1000Bk to H1000LM (simply referred to as an ink jet recording head H1000 below) are carried by a carriage M4100 and discharge an ink droplet according to an input electric signal.

The ink jet recording head H1000 includes discharge port arrays corresponding to a width of a recording medium K1000. Regarding the recording performed by the ink jet recording apparatus M4000, the recording medium K1000 is moved in the longitudinal direction (the direction of the arrow in FIG. 1) while the ink jet recording head H1000 is fixed. However, the ink jet recording head according to the present invention may also be used for a serial drive type ink jet recording apparatus. The recording head of the serial drive ink jet recording apparatus reciprocately moves in the widthwise direction of the recording medium together with the carriage while it performs recording.

Figure 2:
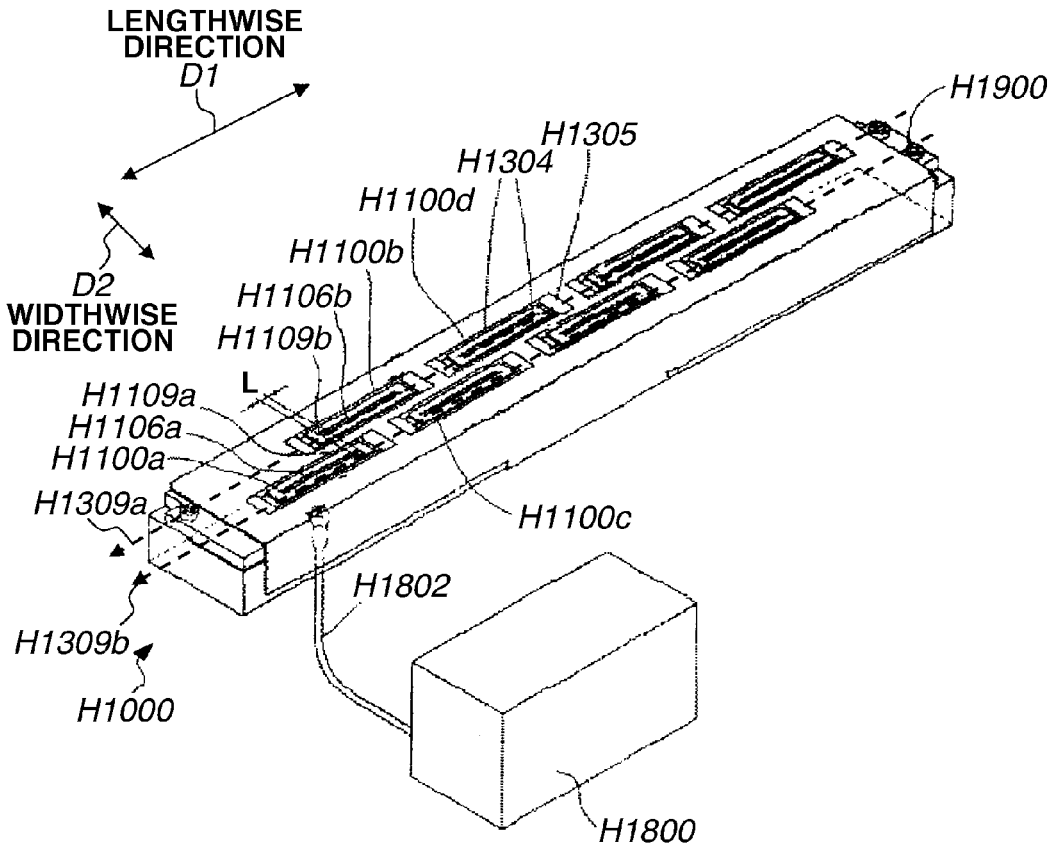
FIG. 2 is a perspective view of the inkjet recording head according to an exemplary embodiment of the present invention.

FIG. 2 is a perspective view of the ink jet recording head according to an exemplary embodiment of the present invention. The ink jet recording head H1000 illustrated in FIG. 2 is any one of the above-described ink jet recording heads H1000Bk, H1000C, H1000M, H1000Y, H1000LC, and H1000LM. Details of the ink jet recording head according to the present exemplary embodiment will now be described referring to the figures.

Figure 3A:
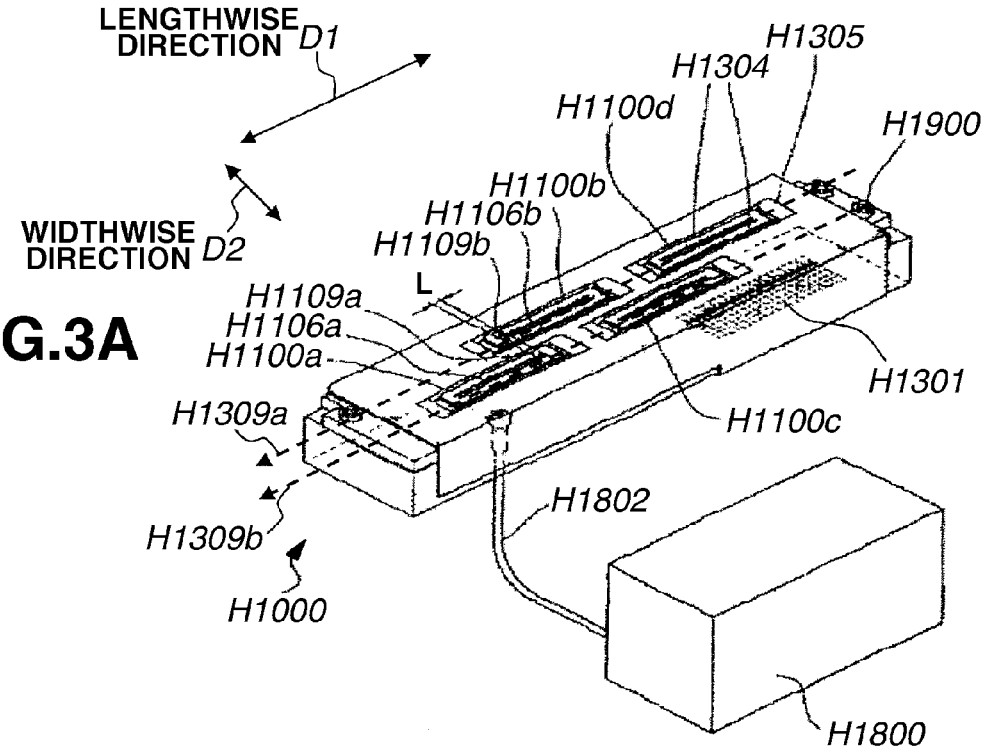
FIGS. 3A and 3B are perspective views illustrating a configuration of the ink jet recording head according to the present invention.
Figure 3B:
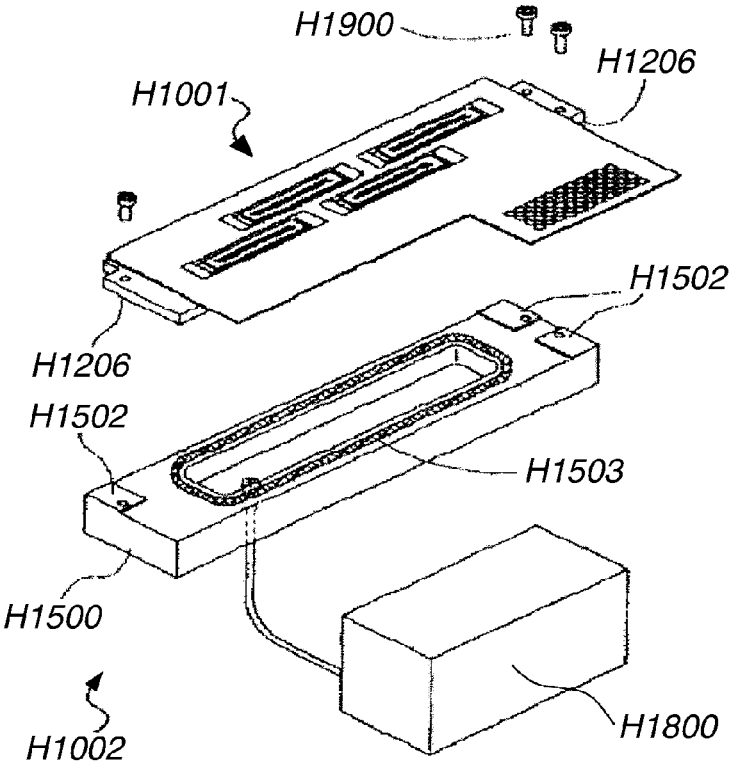

FIGS. 3A and 3B are perspective views of a configuration of the ink jet recording head according to the present invention. FIG. 3A is an external appearance perspective view, and FIG. 3B is an exploded perspective view.

The ink jet recording head H1000 illustrated in FIG. 3 has a smaller number of recording element substrates H1100 compared to the ink jet recording head H1000 illustrated in FIG. 2 to simplify the illustration. Thus, the ink jet recording head H1000 illustrated in FIG. 3 has a similar configuration to the ink jet recording head H1000 illustrated in FIG. 2 except that the number of the recording element substrates H1100 is different.

The discharge direction of an ink droplet of the ink jet recording head H1000 according to the present invention is perpendicular with respect to the recording element. This type of recording head is called a side-shooter type recording head. As illustrated in FIG. 3B, the ink jet recording head H1000 includes a recording element unit H1001 and an ink supply member H1500 of an ink supply unit H1002.

Figure 4:
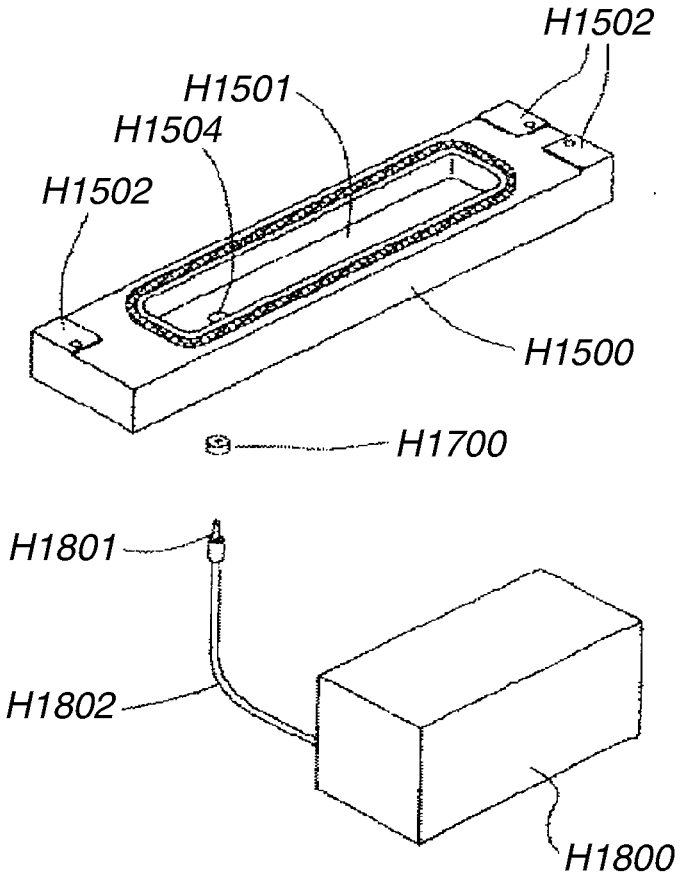
FIG. 4 is an exploded perspective view of an ink supply unit.

First, the configuration of the ink supply unit H1002 will be described. FIG. 4 is an exploded perspective view of the ink supply unit H1002. As illustrated in FIG. 4, the ink supply unit H1002 includes the ink supply member H1500, a joint rubber H1700, an ink supply tube H1802, and an ink tank H1800.

The ink supply member H1500 is formed, for example, by resin molding. The ink supply member H1500 includes a common liquid chamber H1501, which serves as a flow path, and also a Z direction reference plane H1502. The Z direction reference plane H1502 is used for positioning the recording element unit H1001 when it is fixed to the ink supply unit H1002. Further, the Z direction reference plane H1502 serves as a reference plane of the ink jet recording head H1000 in the height direction.

Further, the ink supply unit H1002 includes an ink supply port H1504 through which the ink supplied from the ink tank H1800 flows in. The joint rubber H1700 is provided at the ink supply port H1504. The joint rubber H1700 prevents evaporation of the ink from the ink supply port H1504.

The ink supply tube H1802, which extends from the ink tank H1800, is connected to the ink supply member H1500 by a needle H1801, which is provided at the end of the ink supply tube H1802, piercing the joint rubber H1700. The ink contained in the ink tank H1800 of the ink supply unit H1002 flows into the common liquid chamber H1501 via the ink supply tube H1802. The ink in the common liquid chamber H1501 flows out to the recording element unit H1001.

Next, securing processing of the recording element unit H1001 to the ink supply member H1500 will be described referring to FIG. 3B. The ink jet recording head H1000 is completed by securing the recording element unit H1001 to the ink supply member H1500. The securing processing is as described below.

First, an opening portion of the ink supply member H1500 and the recording element unit H1001 are sealed by a sealing compound H1503. Accordingly, the common liquid chamber H1501 is hermetically sealed. At this time, a Z direction reference plane H1206 of the recording element unit H1001 abuts the Z direction reference plane H1502 of the ink supply member H1500.

A portion where the Z direction reference plane H1206 abuts the Z direction reference plane H1502 is clamped by a screw H1900. In this manner, the recording element unit H1001 is secured to the ink supply member H1500. The sealing compound H1503 is desirably a sealing compound, which is ink resistant and flexible.

After the recording element unit H1001 is secured to the ink supply member H1500, the recording element unit H1001 is bent along the side of the ink supply member H1500 so that an input terminal H1301 is secured to the back side of the ink supply member H1500 (see FIG. 3A).

Figure 5:
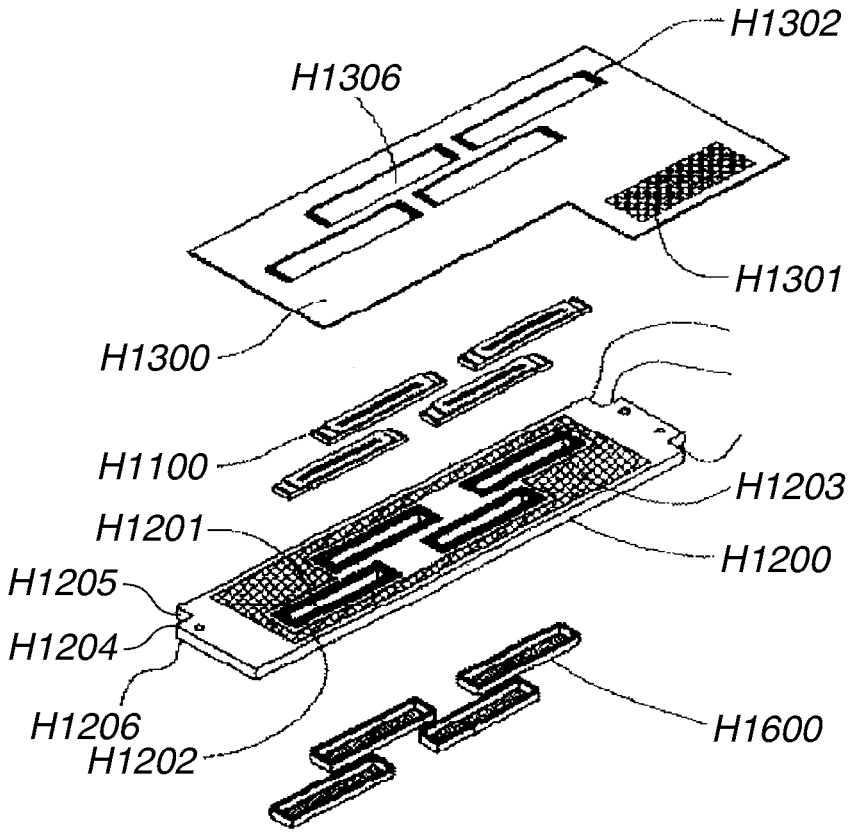
FIG. 5 is an exploded perspective view of a recording element unit.

Next, the configuration of the recording element unit H1001 will be described. FIG. 5 is an exploded perspective view of the recording element unit H1001. As illustrated in FIG. 5, the recording element unit H1001 includes the recording element substrate H1100, a supporting member H1200, an electric wiring member H1300, and a filter member H1600.

Figure 6A:
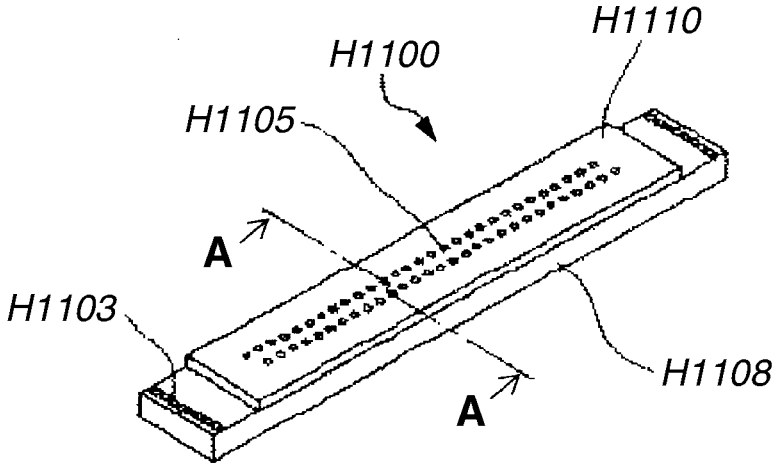
FIGS. 6A and 6B illustrate a configuration of a recording element substrate in the ink jet recording head according to an exemplary embodiment of the present invention.
Figure 6B:
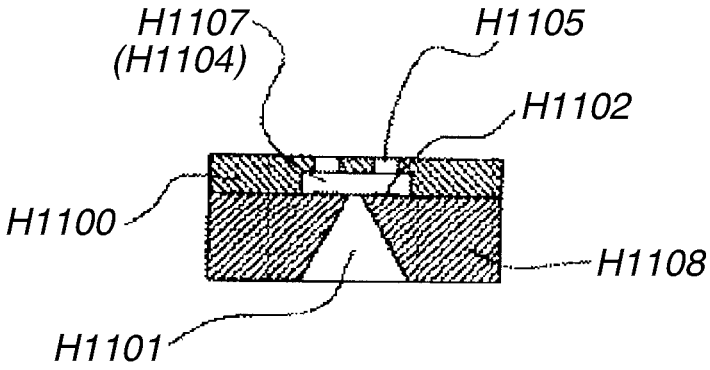

FIGS. 6A and 6B illustrate a configuration of the recording element substrate H1100. FIG. 6A is a perspective view of the recording element substrate H1100. FIG. 6B is a cross-sectional view of the recording element substrate H1100 along the line A-A in FIG. 6A. The recording element substrate H1100 is, for example, a silicon substrate H1108 having a thickness of 0.2 to 1 mm.

The silicon substrate H1108 includes an ink supply port H1101, which is a long channel-like port serving as an ink flow path. An electrothermal conversion element H1102, which is a recording element, is provided on either side of the ink supply port H1101. Further, the silicon substrate H1108 includes the electrothermal conversion element H1102 and electric wiring of, for example, aluminum formed by a film forming technique. The electric wiring is formed at the end of the recording element substrate H1100 and is connected to an electrode H1103. Via the electrode H1103, the electric wiring receives an electric signal and power from the electric wiring member H1300.

Further, a discharge port plate H1110 is provided at the upper portion of the silicon substrate H1108. An ink flow path H1104, a discharge port H1105, and a bubble generation chamber H1107 are formed on the discharge port plate H1110 using photolithography technique. The discharge port H1105 is formed at such a position that it faces the electrothermal conversion element H1102.

Regarding the recording element substrate H1100, the electrothermal conversion element H1102 generates a bubble in the ink that is supplied from the ink supply port H1101 to the bubble generation chamber H1107 according to an electric signal received by the electrode H1103. Due to this bubble, the ink is discharged from the discharge port H1105.

The supporting member H1200 illustrated in FIG. 5 is made from, for example, alumina ($Al_2O_3$) having a thickness of 0.5 to 10 mm. However, the material of the supporting member H1200 is not limited to alumina, and may be a material having a coefficient of linear expansion similar to that of the recording element substrate H1100 and having a thermal conductivity similar to or higher than the recording element substrate H1100.

The material that can be used for the supporting member H1200 is silicon (Si), aluminum nitride (AlN), zirconia, silicon nitride ($Si_3N_4$), silicon carbide (SiC), molybdenum (Mo), and tungsten (W). The supporting member H1200 has an ink supply port H1201 used for supplying ink to the recording element substrate H1100.

The recording element substrate H1100 is accurately positioned and secured to the supporting member H1200 by an adhesive H1202 so that the ink supply port H1201 faces the ink supply port H1101 of the recording element substrate H1100. The adhesive H1202 is desirably a low-viscosity ink-resistant adhesive that allows thin adhesive layer on the contact face and exhibiting relatively high hardness after cure. In other words, the adhesive H1202 is a thermal curing adhesive having epoxy resin as the main material or a thermal curing adhesive, which can also be cured by ultraviolet. The thickness of the adhesive layer is desirably 50 μm or thinner.

Further, the supporting member H1200 includes an X direction reference plane H1204, a Y direction reference plane H1205, and the Z direction reference plane H1206. These are positional reference planes respectively in the lengthwise direction, crosswise direction, and height direction when the supporting member H1200 is mounted on the ink supply member H1500. Further, since both sides of the supporting member H1200 are polished, the principal surface (see FIG. 5), to which the adhesive 1202 is applied, is accurately parallel to the other side (back side) of the principal surface.

For example, according to the present exemplary embodiment, the parallelism of the two sides is 10 μm or less. At the back side of the supporting member H1200, there is provided the filter member H1600 used for filtering undesired matter in the ink. The filter member H1600 is secured in such a manner that it covers the ink supply port H1201.

As illustrated in FIGS. 2 and 3A, a plurality of the recording element substrates H1100 are fixed to the principal surface of the supporting member H1200 in an array in a lengthwise direction D1 of the supporting member H1200. According to this arrangement, a wide area can be recorded with a same color. For example, according to the ink jet recording head H1000 illustrated in FIG. 3A, a 4-inch width recording is possible by arranging four recording element substrates H1100*a*, H1100*b*, H1100*c*, and H1100*d* whose length of the discharge port array is longer than one inch.

Further, as illustrated in FIGS. 2 and 3A, the recording element substrates H1100*a* and H1000*c* are arranged along a first straight line H1309*a* on the ink jet recording head H1000. The first straight line H1309*a* extends in the lengthwise direction D1. Additionally, the recording element substrates H1100*b* and H1000*d* are arranged along a second straight line H1309*b*. The second straight line H1309*b* also extends in the lengthwise direction D1 but is away from the first straight line H1309*a*. The four recording element substrates are provided in an alternating arrangement along the lengthwise direction D1.

Further, the recording element substrates adjacent to each other in a widthwise direction D2 of the supporting member H1200 have a region L where the ends of the discharge port arrays of the substrates overlap each other (see FIGS. 2 and 3A). According to this region L, a printing gap, which may be generated between the recording element substrates of the ink jet recording head H1000, is prevented. For example, a discharge port array H1106*a* and a discharge port array H1106*b* have overlapping regions H1109*a* and H1109*b* respectively (see FIGS. 2 and 3A).

The electric wiring member H1300 is a resin component that supplies an electric signal for controlling discharge of ink to the recording element substrate H1100. The electric wiring member H1300 is secured to the principal surface of the supporting member H1200 by an adhesive H1203 (see FIG. 5). In other words, the electric wiring member H1300 is a flexible film component having a circuit (not shown) made of a thin resin film, such as a polyimide film, clad with copper foil and covered with a cover lay.

The electric wiring member H1300 includes a plurality of device holes H1306. Each of the device holes H1306 individually exposes each of the recording element substrates H1100. Further, an electrode terminal H1302 used for transmitting an electric signal to the electrode H1103 is provided in the periphery of a device hole H1306 on the sides in the lengthwise direction D1. Further, the input terminal H1301, which is provided at one portion of the electric wiring member H1300, is connected to the electrode terminal H1302 via the above-described circuit.

Figure 20:
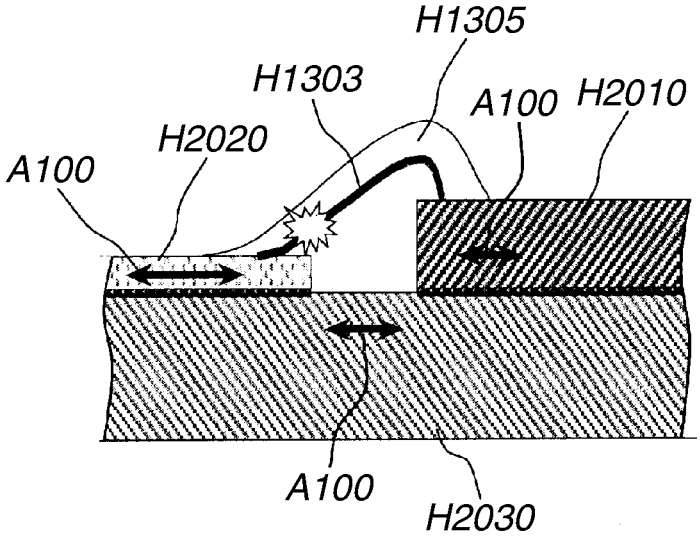
FIG. 20 is a cross section of the ink jet recording head illustrated in FIG. 18 when a change in temperature occurs.

The electrode terminal H1302 is electrically connected to the electrode H1103 with a gold or an aluminum wire H1303 as is the electrode terminal of the ink jet recording head H2000 in FIG. 20. Since the electrical connection portion is encapsulated by an encapsulant H1305, it is protected from erosion due to ink or from an external impact (see FIG. 20). A gap portion, which is formed by the device hole H1306 and the sides of the recording element substrate H1100, is encapsulated by an encapsulant H1304 (see FIG. 2).

Figure 7:
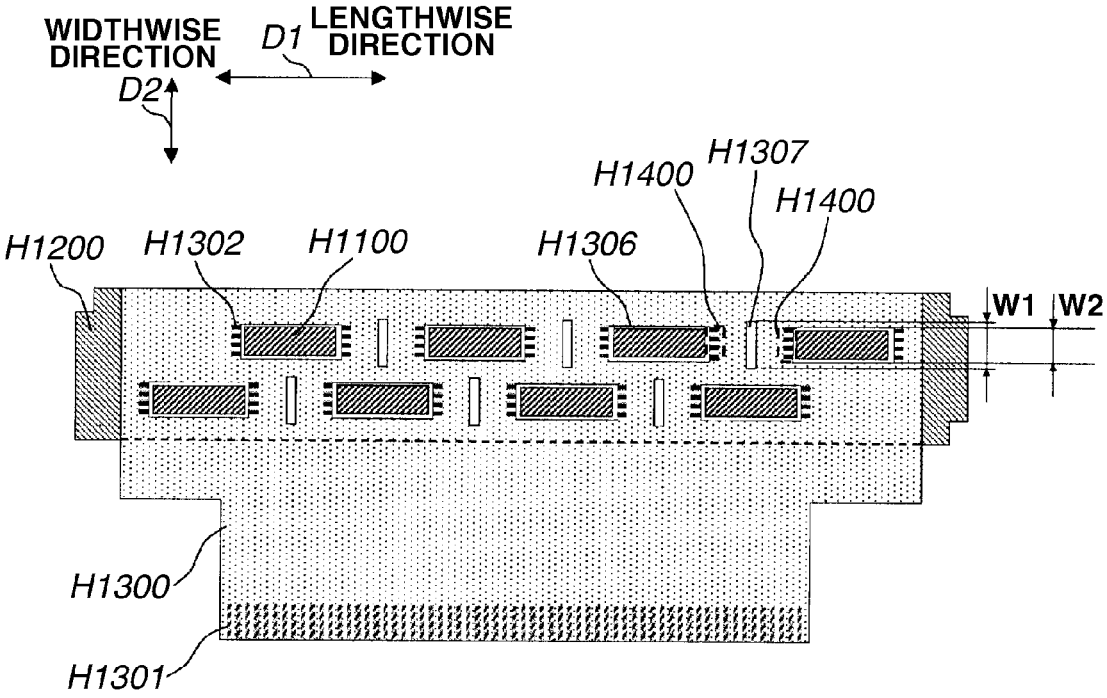
FIG. 7 is a front view of the ink jet recording head according to an exemplary embodiment of the present invention.

FIG. 7 is a front view of the ink jet recording head according to the present exemplary embodiment. In FIG. 7, the electrode terminal H1302, the recording element substrate H1100, and the device hole H1306 are illustrated without the wire H1303 and the encapsulant H1305 described above so that the positional relations between the components can be seen clearly.

As illustrated in FIG. 7, the electric wiring member H1300 includes a terminal region H1400 where a plurality of electrode terminals H1302 are formed along the periphery of the device hole H1306 on the sides in the longitudinal direction D1. Further, the electric wiring member H1300 has an opening H1307 between the device holes H1306 adjacent to each other. An opening width w1, which is the width of the opening H1307 in the widthwise direction D2, is longer than a region width w2, which is the length between the electrode terminals that are provided at both ends of the terminal region H1400.

An amount of expansion/contraction ΔL of a member due to temperature change is calculated by multiplying an amount of temperature change ΔT, a coefficient of linear expansion a of the member, and a length L of the member as shown in the following equation (1).

$$\Delta L = \Delta T \times \alpha \times L \quad (1)$$

Among the factors that define the amount of expansion ΔL, the amount of temperature change is difficult to control, and the coefficient of linear expansion is uniquely determined by the selected member. Thus, according to the present invention, in preventing the breaking of the wire H1303 that occurs due to the difference of the amount of expansion/contraction between the electric wiring member H1300 and the recording element substrate H1100 caused by temperature changes, the opening H1307 is formed so that the length of the electric wiring member H1300 is changed.

In other words, by forming the opening H1307, whose opening width w1 is longer than or equal to the region width W2, between the device holes H1306, which are adjacent to each other in the lengthwise direction of the recording element substrate, the amount of expansion/contraction of the electric wiring member H1300 can be reduced. As a result, since the difference in the amount of expansion/contraction between the recording element substrate H1100 and the electric wiring member H1300 due to temperature change is reduced, the stress of the wire H1303 is reduced. Accordingly, the wire H1303 will be less prone to breaking, and reliability of the electrical connection between the recording element substrate H1100 and the electric wiring member H1300 will be increased.

As the opening width W1 becomes wider than the region width w2, the region that helps reduce the amount of expansion/contraction of the electric wiring member H1300 becomes longer. Accordingly, the effect to prevent the wire H1303 from breaking will be increased. If the opening width W1 is set to be wider than the region width w2, the wiring region enough for the circuit will be provided on the electric wiring member H1300 by not allowing one end of the opening H1307 to extend to the edge of the electric wiring member H1300.

According to the present exemplary embodiment, the opening H1307 is provided at a same distance from the device holes H1306 adjacent to each other in the lengthwise direction D1. The position is determined so that a similar effect is obtained in reducing the difference of the amount of expansion/contraction between the recording element substrate H1100 and the electric wiring member H1300 between the device holes H1306 adjacent to each other.

Figure 8:
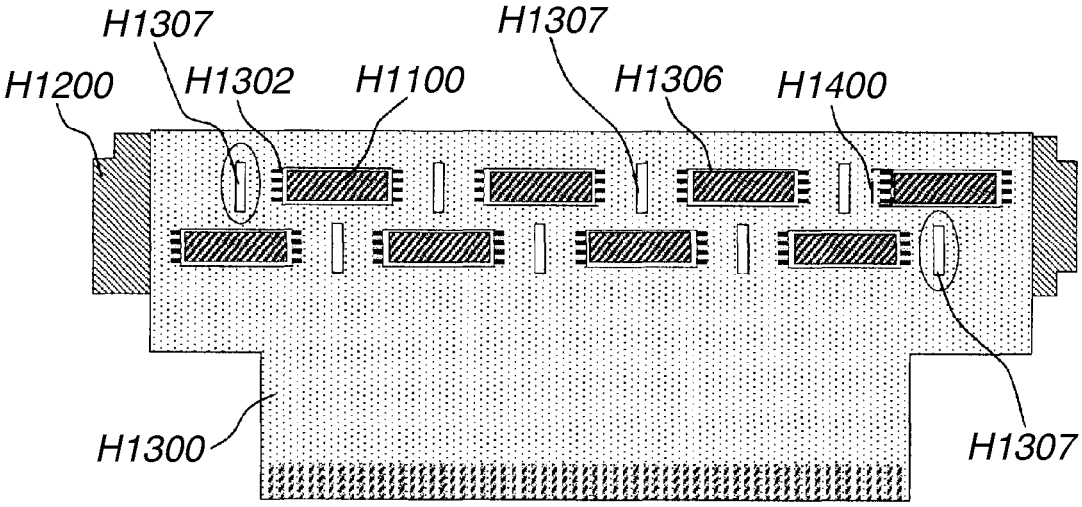
FIG. 8 is a front view of the ink jet recording head according to another exemplary embodiment of the present invention.

Further, according to the present exemplary embodiment, the position of the opening H1307 is not limited to the region between the device holes H1306 adjacent to each other. For example, as illustrated in FIG. 8, if the region between the end of the electric wiring member H1300 in the lengthwise direction D1 and the terminal region H1400 (see the region surrounded by a circle in FIG. 8) is long, the opening H1307 can be provided in that region. According to this opening H1307, the stress of the wire H1303 near the end of the electric wiring member is reduced and, accordingly, the wire H1303 will be less prone to breaking.

Figure 9:
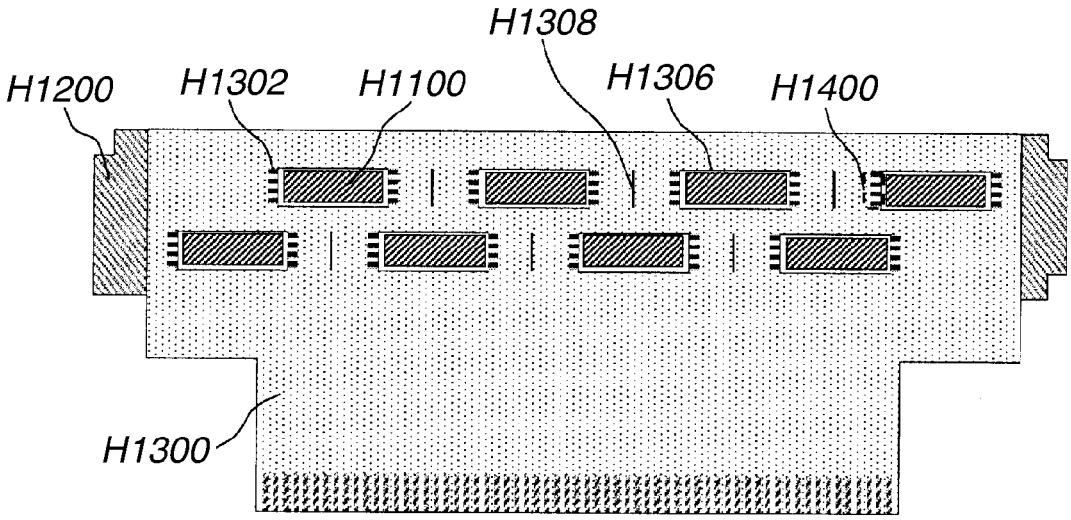
FIG. 9 is a front view of the ink jet recording head according to another exemplary embodiment of the present invention.

Further, according to the present exemplary embodiment, the length of the straight line region of the electric wiring member H1300 can be reduced without using the above-described opening H1307. For example, as illustrated in FIG. 9, in place of the opening H1307, a cut portion H1308 may be provided. In this case also, since the electric wiring member H1300 is discontinued in the lengthwise direction D1 between the device holes H1306 adjacent to each other, an effect similar to the case where the opening H1307 is used can be obtained.

Figure 10:
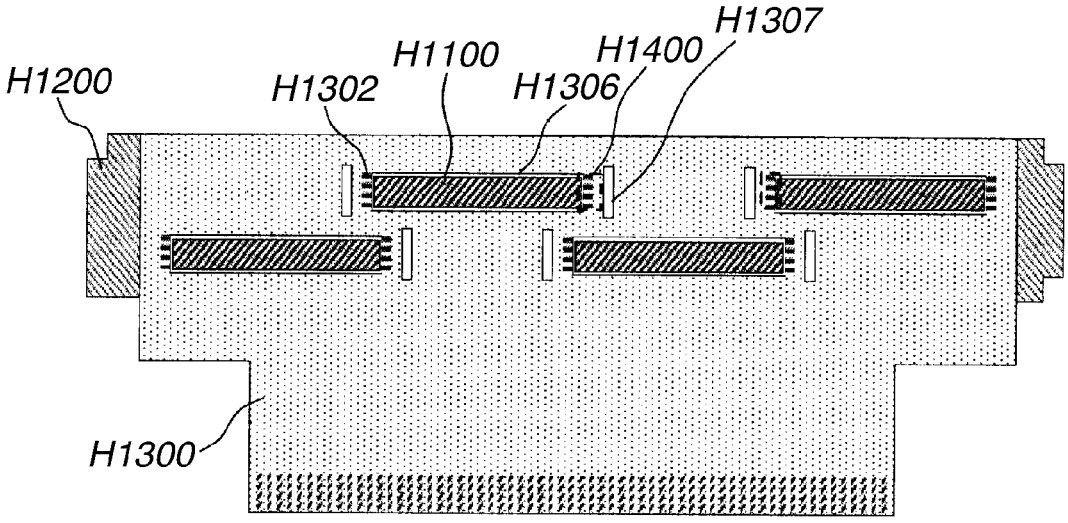
FIG. 10 is a front view of the ink jet recording head according to another exemplary embodiment of the present invention.

Further, as illustrated in FIG. 10, a recording element substrate, which is longer than the recording element substrate H1100 illustrated in FIG. 7 in the lengthwise direction D1, may be used. In this case, the opening H1307 is formed at a position adjacent to the terminal region H1400. According to the equation (1) above, if the recording element substrate H1100 is longer, the amount of expansion/contraction of the recording element substrate H1100 is increased. Thus, the difference of the amount of expansion/contraction between the recording element substrate H1100 and the electric wiring member H1300 due to temperature change is reduced.

Further, by arranging the opening H1307 at a position adjacent to the terminal region H1400, the amount of expansion/contraction in the terminal region H1400 is furthermore reduced. Thus, the difference in the amount of expansion/contraction between the recording element substrate H1100 and the electric wiring member H1300 due to temperature change is furthermore reduced, and the effect to prevent the breaking of the wire H1303 is improved.

Figure 11:
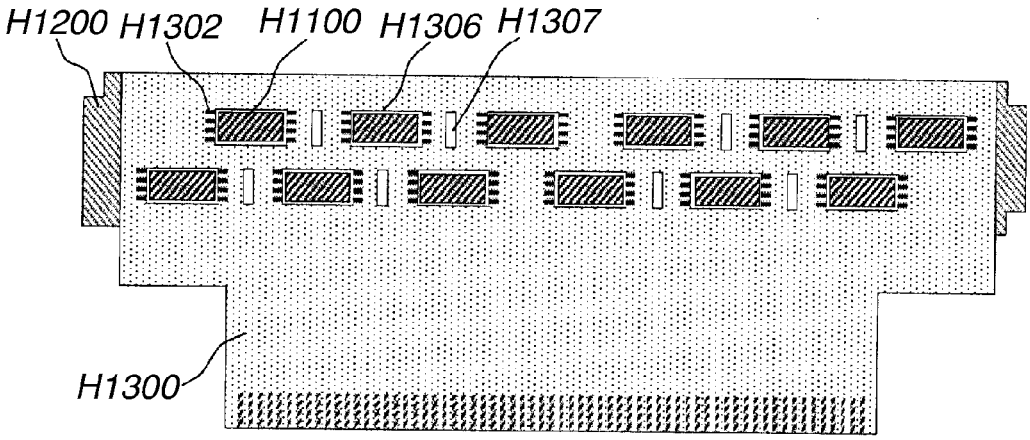
FIG. 11 is a front view of the ink jet recording head according to another exemplary embodiment of the present invention.

Further, as illustrated in FIG. 11, a recording element substrate shorter than the recording element substrate H1100 illustrated in FIG. 7 in the lengthwise direction D1 may be used. In this case, since the distance between the device holes H1306 is shorter than the distance illustrated in FIG. 7, the amount of expansion/contraction of the electric wiring member H1300 is reduced. Accordingly, the difference of the amount of expansion/contraction of the recording element substrate H1100 and the electric wiring member H1300 due to temperature change is reduced, and the wire H1303 will be less prone to breaking.

Figure 12:
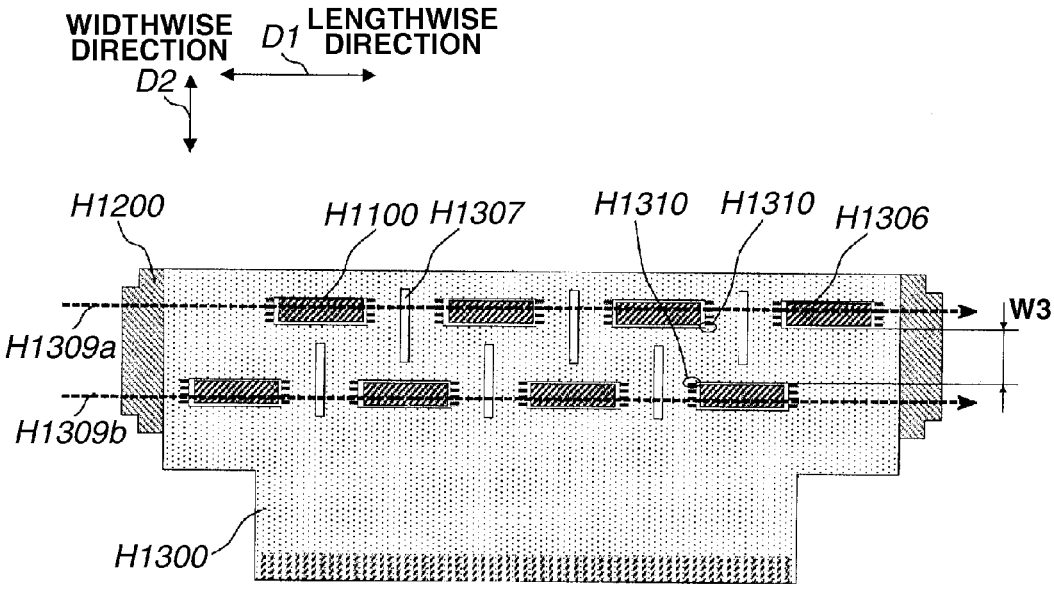
FIG. 12 is a front view of the ink jet recording head according to another exemplary embodiment of the present invention.

FIG. 12 is a front view of an ink jet recording head according to a second exemplary embodiment of the present invention. Components illustrated in FIG. 12, which are similar to those described above according to the first exemplary embodiment, are given the same reference numerals and detailed descriptions will be omitted. Further, in FIG. 12, as is in FIG. 7, the electrode terminal H1302, the recording element substrate H1100, and the device hole H1306 are illustrated without the wire H1303 and the encapsulant H1305 described above so that the positional relations between the components can be seen clearly.

As illustrated in FIG. 12, an interval W3, which is an interval of the device holes H1306 in the widthwise direction D2 of the electric wiring member H1300 of the present exemplary embodiment, is longer than that of the electric wiring member H1300 of the first exemplary embodiment. In other words, according to the present exemplary embodiment, the area between the device holes provided on the first straight line H1309*a* and the device holes provided on the second straight line H1309*b* of the electric wiring member H1300 is greater than that of the electric wiring member H1300 of the first exemplary embodiment.

In this case, an electrode terminal H1310, which is formed at the end of the terminal region H1400, is positioned near the area between the first straight line H1309*a* and the second straight line H1309*b*. Thus, the electrode terminal H1310 is affected by the expansion/contraction generated in that region between the straight lines. Since the amount of expansion/contraction of the region is greater than that of the region where the opening H1307 is formed (the region between device holes H1306 adjacent to each other), the difference of the amount of expansion/contraction of the recording element substrate H1100 and the electric wiring member H1300 at the electrode terminal H1310 will be greater than that at other electrode terminals. Thus, the wire H1303 connected to the electrode terminal H1310 is easily broken compared to the wires connected to other electrode terminals.

However, according to the present exemplary embodiment, since one end of the opening H1307 extends to the area between the first straight line H1309*a* and the second straight line H1309*b*, the length of the straight region becomes shorter. Accordingly, the difference of the amount of expansion/contraction of the recording element substrate H1100 and the electric wiring member H1300 at the electrode terminal H1310 is reduced. Thus, the wire H1303 connected to the electrode terminal H1310 is less prone to breaking.

Figure 13:
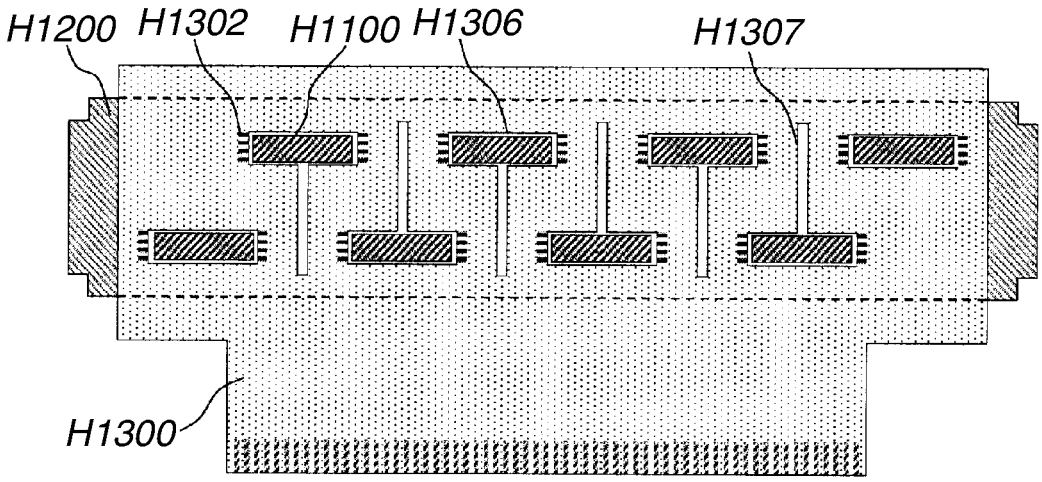
FIG. 13 is a front view of the ink jet recording head according to another exemplary embodiment of the present invention.

Further, according to the present exemplary embodiment, one end of the opening H1307 may be connected to the device hole H1306 to which the opening H1307 extends as illustrated in FIG. 13. In this case, since the region between the device holes positioned on the first straight line H1309*a* and the device holes positioned on the second straight line H1309*b* is discontinued, the amount of expansion/contraction of the electric wiring member H1300 due to temperature change is reduced.

Accordingly, the wire H1303 connected to the electrode terminal H1310 is less prone to breaking. Further, since the opening H1307 is connected to the device hole H1306, the encapsulant for encapsulating the gap portion formed between the device hole H1306 and one side of the recording element substrate H1100 can be injected through the opening H1307.

Figure 14:
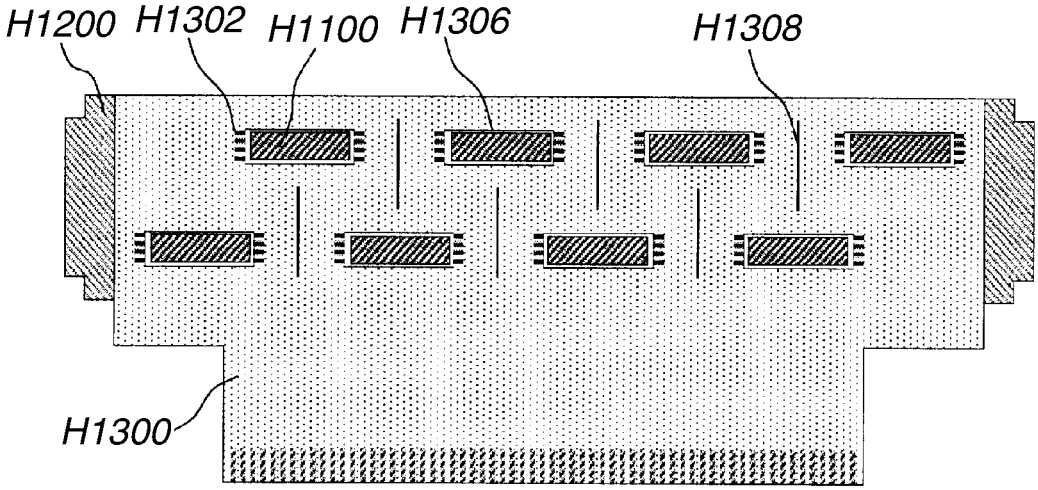
FIG. 14 is a front view of the ink jet recording head according to another exemplary embodiment of the present invention.
Figure 15:
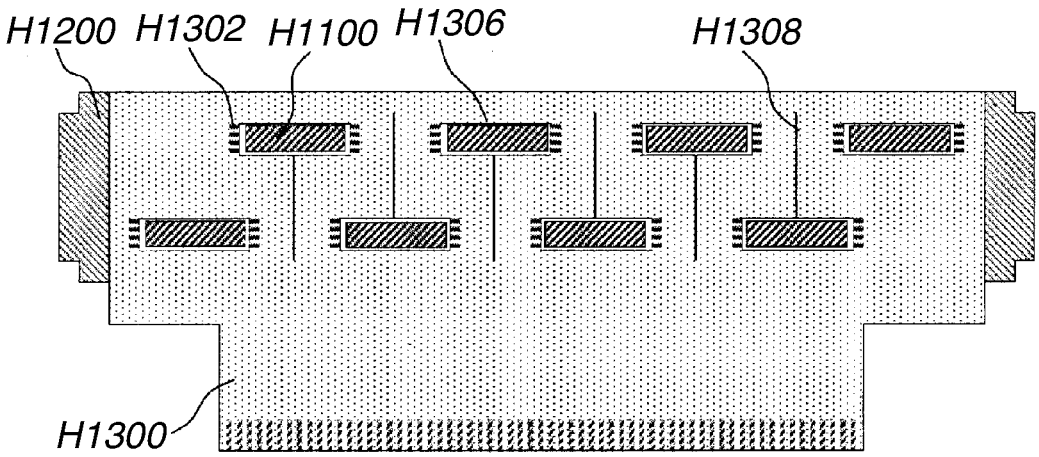
FIG. 15 is a front view of the ink jet recording head according to another exemplary embodiment of the present invention.

Further, according to the present exemplary embodiment, the length of the straight line region of the electric wiring member H1300 can be reduced without forming the above-described opening H1307 as is with the first exemplary embodiment. For example, a cut portion H1308 may be formed in place of the opening H1307 as illustrated in FIGS. 14 and 15.

In this case also, since one end of the cut portion H1308 extends to the straight line region between the device holes provided on the first straight line H1309*a* and the device holes provided on the second straight line H1309*b*, the straight line region can be reduced. Thus, an effect similar to the case where the opening H1307 is formed can be obtained.

Further, as is with the first exemplary embodiment, a recording element substrate, which is shorter or longer in the lengthwise direction D1 than the recording element substrate H1100 illustrated in FIG. 12 (see FIGS. 11 and 12) may also be used as is with the first exemplary embodiment.

Further, according to the present exemplary embodiment, the opening H1307 or the cut portion H1308 may be formed in the region between the end of the electric wiring member H1300 in the lengthwise direction D1 and the terminal region H1400 (see FIG. 8) as is with the first exemplary embodiment.

Further, according to the present exemplary embodiment, not only one end of the opening H1307 can be extended to the region between the first straight line H1309*a* and the second straight line H1309*b* but the other end can also be extended.

Figure 16:
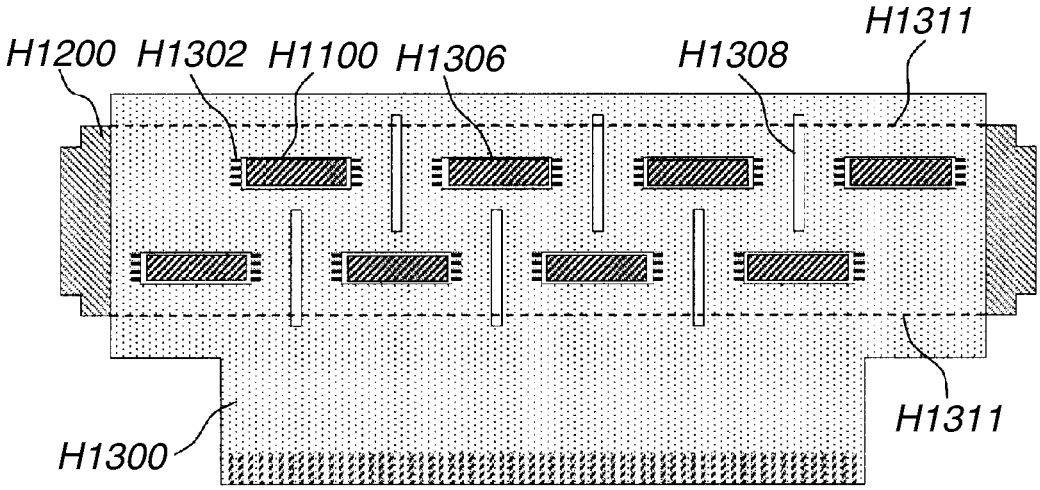
FIG. 16 is a front view of the ink jet recording head according to another exemplary embodiment of the present invention.
Figure 17:
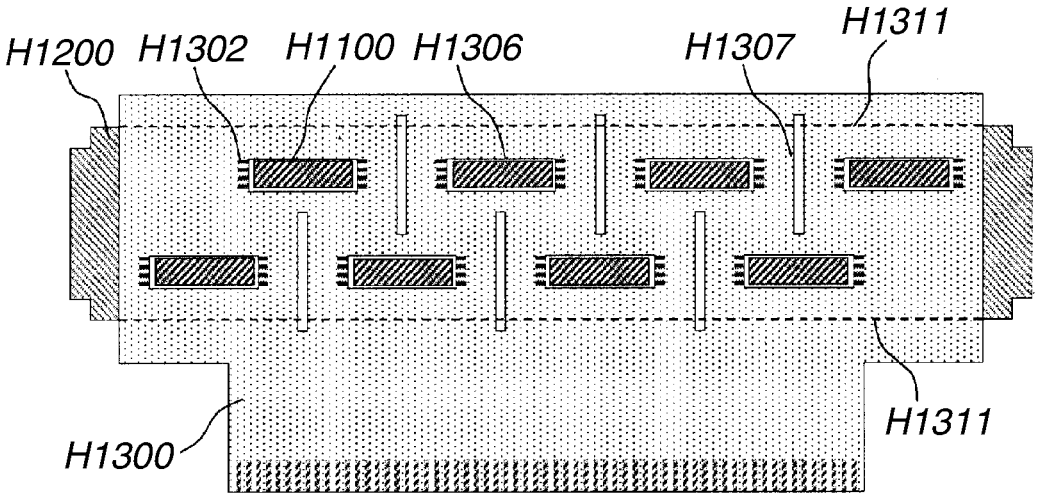
FIG. 17 is a front view of the ink jet recording head according to another exemplary embodiment of the present invention.
Figure 18:
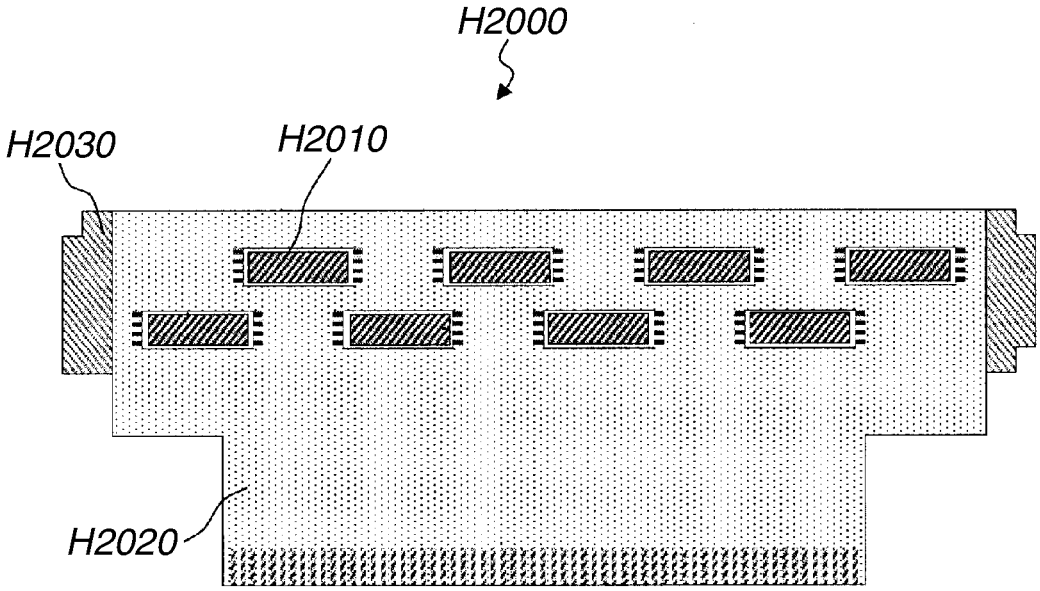
FIG. 18 is a front view of the ink jet recording head with a plurality of recording element substrates according to an exemplary embodiment.
Figure 19:
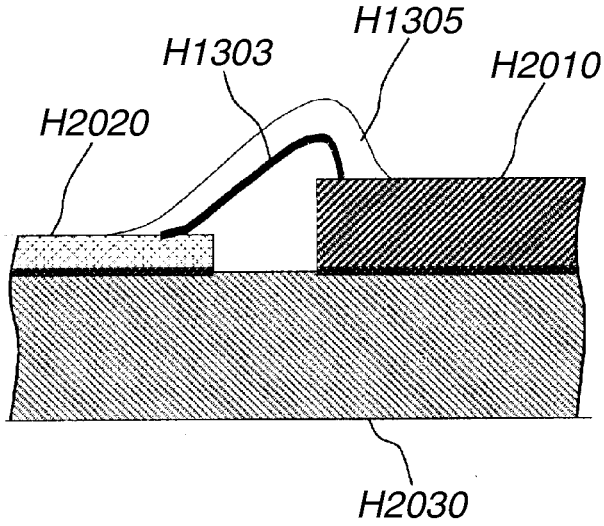
FIG. 19 is a cross section of the ink jet recording head illustrated in FIG. 18.

In other words, as illustrated in FIGS. 16 and 17, one end of the opening H1307 can extend and cross over a fold line H1311, which is formed when the electric wiring member H1300 is bent along the sides of the supporting member H1200 in the lengthwise direction D1. According to these opening, the straight line region that extends in the lengthwise direction D1 in the region near the electrical connection portion of the recording element substrate H1100 and the electric wiring member H1300 is reduced, the amount of expansion/contraction of the electric wiring member H1300 due to temperature change can be furthermore reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-138184 filed Jun. 9, 2009, which is hereby incorporated by reference herein in its entirety.

What is claimed is:

1. An ink jet recording head comprising:

a plurality of recording element substrates including a discharge port configured to discharge a droplet; and an electric wiring member including a plurality of device holes configured to individually expose the plurality of recording element substrates, wherein the electric wiring member is provided with an opening portion or a cut portion disposed between the plurality of device holes, wherein a connecting portion for electrically connecting the record element substrate and the electric wiring member is provided to at least one of peripheries of the plurality of devices holes at a side of the opening portion or the cut portion, wherein the electric wiring member includes a connecting portion region where a plurality of the connecting portions are formed along the periphery, and wherein a length of the opening portion or the cut portion along the plurality of connecting portions is longer than a length between the connecting portions at both ends of the connecting portions region.

2. The inkjet recording head according to claim 1, wherein the opening portion or the cut portion is provided at a same distance from the device holes.

3. The ink jet recording head according to claim 1, wherein the plurality of the recording element substrates are provided in an alternating arrangement along a first straight line, and a second straight line that extends in parallel to but away from the first straight line, and wherein one end of the opening portion or the cut portion extends to a region between a device hole that is positioned on the first straight line and a device hole positioned on the second straight line.

4. The inkjet recording head according to claim 3, wherein one end of the opening portion or the cut portion is connected to a device hole positioned at an extension of the opening portion or the cut portion.

5. The ink jet recording head according to claim 3, wherein one end of the opening portion or the cut portion extends and crosses over a fold line of the electric wiring member.

6. The ink jet recording head according to claim 1, wherein the plurality of the recording element substrates includes a plurality of the discharge ports and a plurality of electrodes provided at both ends in an arranged direction of the plurality of discharge ports;

the electric wiring member includes, at the peripheries of the plurality of device holes, a plurality of electrode terminals each corresponding to each of the plurality of electrodes; and a plurality of the connecting portions connects the plurality of electrodes and the plurality of electrode terminals.

7. The ink jet recording head according to claim 1, further comprising:

a supporting member supporting the plurality of recording element substrates and the electric wiring member.

8. The ink jet recording head according to claim 7, wherein the opening portion of the cut portion is positioned between the device holes adjacent to each other in a lengthwise direction of the supporting member.

9. The ink jet recording head according to claim 1, wherein the connecting portion is provided at each of the peripheries of the plurality of device holes at the side of the opening portion or the cut portion.

10. An ink jet recording head comprising:

a first recording element substrate and a second recording element substrate including a discharge port configured to discharge a droplet; and an electric wiring member including a first device hole configured to expose the first recording element substrate and a second device hole configured to expose the second recording element substrate;

wherein the electric wiring member is provided with an opening portion or a cut portion disposed between the first device hole and the second device hole; and wherein a connecting portion for electrically connecting the first recording element substrate and the electric wiring member is provided to a periphery of the first device hole at a side of the second device hole.

11. The ink jet recording head according to claim 10, wherein another connecting portion for electrically connecting the second recording element substrate and the electric wiring member is provided to a periphery of the second device hole at a side of the first device hole.

* * * * *